US009109592B2

(12) United States Patent
Fujisaki et al.

(10) Patent No.: US 9,109,592 B2
(45) **Date of Patent: *Aug. 18, 2015**

(54) PIEZOELECTRIC MICRO-BLOWER

(71) Applicant: Murata Manufacturing Co., Ltd., Nagaokakyo-shi, Kyoto-fu (JP)

(72) Inventors: Masaaki Fujisaki, Nagaokakyo (JP); Kiyoshi Kurihara, Nagaokakyo (JP); Daisuke Kondo, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/066,958

(22) Filed: Oct. 30, 2013

(65) Prior Publication Data

US 2014/0178220 A1 Jun. 26, 2014

Related U.S. Application Data

(63) Continuation of application No. 12/958,573, filed on Dec. 2, 2010, now Pat. No. 8,596,998, which is a continuation of application No. PCT/JP2009/059951, filed on Jun. 1, 2009.

(30) Foreign Application Priority Data

Jun. 3, 2008 (JP) ..... 2008-145395

(51) Int. Cl.
*F04B 43/04* (2006.01)
*F04B 45/047* (2006.01)
*F04F 7/00* (2006.01)

(52) U.S. Cl.
CPC ..... *F04B 43/046* (2013.01); *F04B 45/047* (2013.01); *F04F 7/00* (2013.01)

(58) Field of Classification Search
CPC ..... F04B 43/046; F04B 45/047; F04B 39/08; F04F 7/00
USPC ..... 417/413.1, 413.2; 92/78, 96, 98 R
See application file for complete search history.

(56) References Cited

U.S. PATENT DOCUMENTS 6,663,351 B2 * 12/2003 Joo ..... 417/53
7,841,843 B2 * 11/2010 Cho et al. ..... 417/413.1

(Continued)

FOREIGN PATENT DOCUMENTS

DE 102 33 235 A1 2/2004
JP 58140491 A * 8/1983 ..... F04B 45/04
JP 2002242898 A * 8/2002 ..... F04D 33/00

OTHER PUBLICATIONS

Official Communication issued in corresponding European Patent Application No. 09758275.3, mailed on Oct. 21, 2014.

(Continued)

*Primary Examiner* — Peter J Bertheaud
*Assistant Examiner* — Dominick L Plakkoottam
(74) *Attorney, Agent, or Firm* — Keating & Bennett, LLP

(57) ABSTRACT

A piezoelectric micro-blower includes an inner case to which a peripheral portion of a vibrating plate including a piezoelectric element is fixed such that a blower chamber is defined between the inner case and the vibrating plate and an outer case arranged to cover an outer periphery of the inner case with a gap therebetween. The inner case is elastically retained in the outer case by a plurality of connecting portions. A first opening is provided in a top plate portion of the inner case that faces a central portion of the vibrating plate, and a second opening is provided in a top plate portion of the outer case that faces the first opening. A central space is provided between the top plate portions, and fluid introduced from the outside is guided to the central space through the gap between the inner and outer cases.

3 Claims, 12 Drawing Sheets

(56) References Cited

U.S. PATENT DOCUMENTS

| | | | | |
|---|---|---|---|---|
| 8,272,851 | B2 * | 9/2012 | Lucas | 417/413.1 |
| 8,596,998 | B2 * | 12/2013 | Fujisaki et al. | 417/413.2 |
| 2005/0074662 | A1 * | 4/2005 | Cho et al. | 429/38 |
| 2005/0089415 | A1 * | 4/2005 | Cho et al. | 417/413.2 |
| 2006/0239844 | A1 * | 10/2006 | Nakayama | 417/413.2 |
| 2007/0065308 | A1 * | 3/2007 | Yamamoto et al. | 417/413.1 |
| 2007/0267940 | A1 | 11/2007 | Wright | |
| 2009/0232683 | A1 * | 9/2009 | Hirata et al. | 417/413.2 |
| 2009/0232684 | A1 * | 9/2009 | Hirata et al. | 417/413.2 |
| 2010/0068080 | A1 * | 3/2010 | Meng et al. | 417/322 |

OTHER PUBLICATIONS

Fujisaki et al., "Piezoelectric Micro-Blower", U.S. Appl. No. 12/958,573, filed Dec. 2, 2010.

* cited by examiner

PIEZOELECTRIC MICRO-BLOWER

BACKGROUND OF THE INVENTION

1. Field of the Invention

The present invention relates to a piezoelectric micro-blower arranged to convey compressible fluid, such as air.

2. Description of the Related Art

A piezoelectric micro-blower is known as an air blower for effectively dissipating heat generated in a housing of a portable electronic apparatus or for supplying oxygen required to generate electric power in a fuel cell. The piezoelectric micro-blower is a type of pump that includes a diaphragm that bends when a voltage is applied to a piezoelectric element, and is advantageous in that the piezoelectric micro-blower has a simple structure, small size and thickness, and low power consumption.

Japanese Examined Patent Application Publication No. 64-2793 discloses a flow-generating apparatus including a base member that includes a compression chamber filled with fluid, a nozzle plate including a nozzle that faces the compression chamber, and a vibrator including an opening and attached to the nozzle plate such that the nozzle is arranged at substantially the center of the opening. The nozzle plate and the vibrator are attached to the base member, and an alternating signal with a frequency close to a resonance frequency of the vibrator is supplied to the vibrator. In this case, no check valve is required and a flow rate can be increased by driving the vibrator at a high frequency. FIG. 5 of Japanese Examined Patent Application Publication No. 64-2793 illustrates a structure in which an inflow air chamber is provided in front of the nozzle plate and airflow ejected from the nozzle is discharged through an outlet together with the air surrounding the airflow in the air chamber.

Japanese Unexamined Patent Application Publication No. 2005-113918 discloses a micro-blower including an ejection unit that sucks in outside air and ejects the air, a cover unit in which an outlet arranged to discharge the air ejected from the ejection unit is provided, and a base unit bonded to the ejection unit. Referring to FIG. 4 of Japanese Unexamined Patent Application Publication No. 2005-113918, an ejection plate including suction holes and an ejection hole is provided, and a vibrating plate provided with a magnetic sheet is attached to a back side of the ejection plate with a compression chamber provided therebetween. The magnetic sheet is vibrated by a coil, so that airflow is ejected through a cavity. The airflow is discharged through the outlet together with air in a cover cavity that is arranged in front of the ejection plate.

Japanese Unexamined Patent Application Publication No. 2006-522896 discloses a gas flow generator including an ultrasonic driver in which a piezoelectric element is bonded to a stainless-steel disc at one side thereof, a first stainless-steel membrane fixed to the stainless-steel disc at the other side thereof, and a second stainless-steel membrane mounted such that a hollow space is provided between the first and second stainless-steel membranes.

High energy efficiency is one of the properties required of micro-blowers. In other words, it is necessary to keep energy loss as low as possible when converting input electrical energy into air ejection flow rate. In Japanese Examined Patent Application Publication No. 64-2793, since a double-wall structure including an inner case and an outer case is provided, vibration of the inner case does not easily leak to the outside. However, since a wall portion that connects the inner case and the outer case to each other is rigid and, in particular, since the wall portion extends in a vibrating direction of the vibrator, vibration of the vibrator is easily transmitted from the inner case to the outer case through the wall portion. The outer case is fixed to, for example, a housing or a substrate of an apparatus. When the vibration of the vibrator leaks to the outer case, there is a problem in that the energy loss increases and the characteristics vary in accordance with a fixing structure arranged to fix the outer case to the housing.

In Japanese Unexamined Patent Application Publication No. 2005-113918, the vibrator is attached to the ejection plate with a reservoir body provided therebetween, and an outer peripheral portion of the ejection plate is fixed to an outer case. The ejection plate is a relatively thick plate that does not vibrate in response to the vibration of the vibrator. Therefore, the vibration of the vibrator is transmitted to the outer case, which increases the energy loss as in Japanese Examined Patent Application Publication No. 64-2793.

In Japanese Unexamined Patent Application Publication No. 2006-522896, the second stainless-steel membrane is fixed to a housing. Since the first stainless-steel membrane and the second stainless-steel membrane are fixed at outer peripheral portions thereof, vibration of the ultrasonic driver directly leaks to the outside. Therefore, it can be assumed that the energy loss is greater than those in Japanese Examined Patent Application Publication No. 64-2793 and Japanese Unexamined Patent Application Publication No. 2005-113918. In addition, there is a possibility that the characteristics will vary in accordance with a fixing structure arranged to fix the second stainless-steel membrane to the housing.

SUMMARY OF THE INVENTION

To overcome the problems described above, preferred embodiments of the present invention provide a piezoelectric micro-blower from which vibration of a vibrating plate does not easily leak to the outside and with which energy loss is reduced.

A piezoelectric micro-blower according to a preferred embodiment of the present invention preferably includes a vibrating plate including a piezoelectric element, an inner case to which a peripheral portion of the vibrating plate is fixed, a blower chamber being provided between the inner case and the vibrating plate, a first opening provided in a wall portion of the inner case, the wall portion facing a central portion of the vibrating plate, an outer case arranged to cover an outer periphery of the inner case without contact such that a predetermined gap is provided between the inner case and the outer case, a second opening provided in a wall portion of the outer case, the wall portion facing the first opening, a plurality of connecting portions that connect the inner case and the outer case to each other, the connecting portions being arranged to prevent transmission of vibration from the inner case to the outer case, and a central space provided between the wall portion of the inner case that faces the vibrating plate and the wall portion of the outer case that faces the wall portion of the inner case, fluid introduced from the outside through the gap being guided into the central space, the central space communicating with the first opening and the second opening. The vibrating plate is driven in a bending mode by applying a voltage with a predetermined frequency to the piezoelectric element, so that compressible fluid is sucked into the central space through the gap and is discharged through the second opening.

When the vibrating plate is driven by applying the voltage with the predetermined frequency to the piezoelectric element, air is sucked in through the first opening in a certain half period as the vibrating plate moves. Then, in the next half period, the air is discharged. A high-speed airflow is discharged through the first opening when the vibrating plate is driven at a high frequency, and is discharged through the second opening together with the air that surrounds the airflow. Thus, the air sucked into the central space through the gap between the inner case and the outer case and the air discharged through the first opening are combined and are discharged through the second opening together. Therefore, an ejection flow rate that is greater than or equal to that corresponding to the displacement volume of the vibrating plate is provided.

The inner case, which is a driving unit, and the outer case, which is a non-driving unit, are preferably connected to each other with a plurality of connecting portions that prevent transmission of vibration from the inner case to the outer case. Therefore, leakage of vibration of the inner case to the outer case is effectively reduced, and the energy loss is reduced accordingly. Therefore, the electrical energy input to the piezoelectric element is efficiently converted into the air flow rate. Thus, an efficient piezoelectric micro-blower is provided. In addition, the inner case, which is the driving unit, and the outer case, which is the non-driving unit, are preferably provided as individual components that are separate from each other. Therefore, characteristics of the micro-blower are prevented from being varied when the micro-blower is mounted to a housing or other suitable structure. In addition, the entire area of the gap between the inner case and the outer case can preferably be used as an inflow passage, so that the flow passage resistance is reduced and the flow rate is further increased. Although the connecting portions are disposed in the inflow passage, the connecting portions do not substantially increase the flow passage resistance since the connecting portions may preferably be provided with intervals therebetween in a circumferential direction.

The vibrating plate may preferably be of a unimorph type in which a piezoelectric element that expands and contracts in a planar direction is bonded to a diaphragm (for example, a metal plate) at one side thereof, a bimorph type in which piezoelectric elements that expand and contract in opposite directions are bonded to the diaphragm at either side thereof, or a bimorph type in which a layered piezoelectric element which itself bends is bonded to the diaphragm at one side thereof. Alternatively, the diaphragm may be omitted and a piezoelectric element that functions as a vibrating plate by itself may be used. The shape of the piezoelectric element may preferably be a disc shape, a rectangular shape, or an annular shape, for example. An intermediate plate may preferably be bonded between the piezoelectric element and the diaphragm. In any case, the vibrating plate is not limited as long as the vibrating plate can be bent in a thickness direction by applying an alternating voltage (alternating-current voltage or square-wave voltage) to the piezoelectric element.

The vibrating plate is preferably driven in the first resonance mode (at the first resonance frequency) since the largest displacement is obtained in this mode. However, the first resonance frequency is in the audible range of human beings, and there is a risk that a large noise will be generated. In contrast, when the third resonance mode (third resonance frequency) is used, although the displacement is reduced as compared to that in the first resonance mode, a larger displacement is obtained as compared to a case in which the resonance mode is not used. In addition, since the vibrating plate can be driven at a frequency beyond the audible range of human beings, the generation of noise is prevented. The first resonance mode is a vibration mode in which the vibrating plate has a single loop, and the third resonance mode is a vibration mode in which the vibrating plate has a loop at each of a central portion and a peripheral portion thereof.

The wall portion of the inner case is preferably arranged so as to vibrate when the vibrating plate is driven. In particular, the wall portion of the inner case is preferably arranged so as to resonate in response to resonance vibration of the vibrating plate. More specifically, the natural frequency of a portion of the wall portion of the inner case that faces the central space may preferably be set to a frequency close to the resonance frequency of the vibrating plate, an integral multiple of the resonance frequency of the vibrating plate, or a frequency calculated by dividing the resonance frequency of the vibrating plate by an integer, for example. In such a case, the wall portion of the inner case is caused to resonate so as to follow the movement of the vibrating plate. In this case, the flow rate of the flow of fluid generated by the vibrating plate is increased by the movement of the wall portion of the inner case. Therefore, the flow rate is further increased. The vibrating plate and the wall portion of the inner case may be vibrated in the same resonance mode. Alternatively, one of the vibrating plate and the wall portion of the inner case may be vibrated in the first resonance mode while the other vibrates in the third resonance mode.

The connecting portions are preferably defined by spring members that are capable of moving in the same direction as a direction in which the vibrating plate vibrates. The direction in which the connecting portions move is not particularly limited. However, when the connecting portions are defined by spring members capable of moving in the same direction as the direction in which the vibrating plate vibrates, leakage of vibration from the inner case to the outer case is more effectively reduced.

The wall portion of the inner case that faces the vibrating plate may preferably be defined by an elastic metal plate, and the connecting portions may preferably be defined by elastic pieces disposed on an outer peripheral portion of the elastic metal plate with intervals provided between the elastic pieces in a circumferential direction. In addition, outer end portions of the elastic pieces may preferably be fixed to the outer case. In this case, the connecting portions are integral with the elastic metal plate that defines the wall portion of the inner case. Therefore, the strength of the connecting portions is easily ensured and the inner case and the outer case can be easily attached to each other.

According to a preferred embodiment of the present invention, one end portion of each connecting portion is preferably connected to the wall portion of the inner case at a node of vibration of the wall portion. Since the connecting portions are connected at locations at which the vibration of the wall portion of the inner case is smallest, leakage of vibration of the inner case to the outer case is further reduced. As a result, the energy loss is further reduced. The vibration mode of the wall portion of the inner case varies in accordance with the vibration mode of the vibrating plate. In the case in which, for example, the wall portion of the inner case vibrates in a vibration mode such that the node is located at the outer peripheral edge, the connecting portions are connected to an outer peripheral edge portion of the wall portion of the inner case. Accordingly, leakage of vibration is effectively reduced. In addition, in the case where the wall portion of the inner case vibrates in a vibration mode such that a node portion is inwardly spaced from the outer peripheral edge, the connecting portions are preferably connected to this node portion. Accordingly, leakage of vibration is effectively reduced. When the connecting portions are connected to the node portion in the above-described manner, it is not always necessary that the connecting portions have spring elasticity.

However, it is preferable that the connecting portions have a structure that allows variation in inclination of the node portion of the wall portion of the inner case.

Where the connecting portions are connected to the wall portion of the inner case at a node of vibration of the wall portion, the connecting portions may preferably be arranged so as to project from the wall portion of the inner case in a vertical or substantially vertical direction, and end portions of the connecting portions at the other end may be connected to the wall portion of the outer case that faces the wall portion of the inner case. In this case, a gap that has a dimension equal or substantially equal to the length of the connecting portions may preferably be provided between the wall portion of the inner case and the wall portion of the outer case as the central space. In addition, where the connecting portions are connected to the wall portion of the inner case at the node of vibration of the wall portion, the connecting portions may preferably be arranged so as to project radially outward in a direction parallel or substantially parallel to the wall portion of the inner case, and end portions of the connecting portions at the other end may be connected to an inner side wall of the outer case. In this case, cut portions, slits, or the like are preferably provided in the inner case so that the outer peripheral portion of the inner case does not come into contact with each connecting portion.

A diameter of the piezoelectric element may be larger than an inner diameter of the blower chamber. In the case where the diameter of the piezoelectric element is larger than the inner diameter of the blower chamber, the overall body of the driving unit including the vibrating plate and the inner case can easily vibrate such that the outer peripheral edge thereof serves as a free end. Therefore, when the outer peripheral edge of the driving unit is retained by the connecting portions having spring elasticity or is retained by the connecting portions at the node of vibration of the driving unit, the displacement of the vibrating plate is increased. As a result, the displacement of the top plate of the inner case can be increased and the flow rate can be increased accordingly.

Preferably, a peripheral wall portion that surrounds the central space projects from the wall portion of the inner case or the wall portion of the outer case, and an inflow passage is provided in the peripheral wall portion, the inflow passage extending from the gap between the inner case and the outer case to the central space. In addition, preferably, a small gap is provided between an end surface of the peripheral wall portion and one of the wall portion of the inner case or the wall portion of the outer case that faces the end surface. In this case, the central space communicates with the outside not only through the inflow passage but also through the small gap over the entire or substantially the entire circumference of the central space. Therefore, the flow passage resistance against the air that flows into the central space can be reduced and the efficiency of the blower can be increased. If the wall portion of the inner case resonates in response to the resonance vibration of the vibrating plate, the small gap between the peripheral wall portion and the wall portion of the inner case is preferably set such that the wall portion of the inner case does not come into contact with the peripheral wall portion when the wall portion of the inner case resonates. In this case, not only a portion of the wall portion of the inner case that faces the central space but also a portion surrounding the portion that faces the central space is arranged to resonate together. Therefore, the driving area of the wall portion of the inner case is increased and the flow rate can be increased accordingly.

Preferably, the inner case is made of a metal material and the outer case is made of a resin material. Where the inner case is made of a metal material, one of electrodes of the piezoelectric element can be connected to the outside using the inner case as an electricity conducting path. In addition, where the outer case is made of an insulating material, the electrodes of the piezoelectric element can be prevented from being short-circuited to the housing when the outer case is fixed to a housing or other suitable structure.

As described above, in the piezoelectric micro-blower according to various preferred embodiments of the present invention, the inner case, which is a driving unit, and the outer case, which is a non-driving unit, are provided as individual components that are separate from each other. The inner case and the outer case are connected to each other with a plurality of connecting portions that prevent transmission of vibration from the inner case to the outer case. Therefore, leakage of vibration of the inner case to the outer case is reduced and the energy loss is reduced accordingly. In addition, variations in characteristics caused when the outer case is attached to a housing or other suitable structure is reduced. In addition, the entire area of the gap between the inner case and the outer case can be used as the inflow passage, so that the flow passage resistance can be reduced. As a result, an efficient piezoelectric micro-blower is obtained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be described with reference to the drawings.

First Preferred Embodiment

Figure 1:
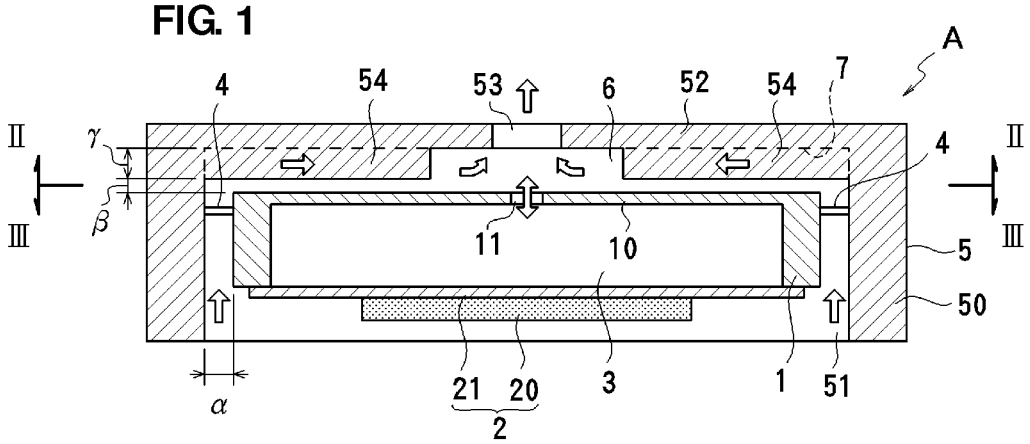
FIG. 1 is a schematic sectional view of a piezoelectric micro-blower according to a first preferred embodiment of the present invention.
Figure 2:
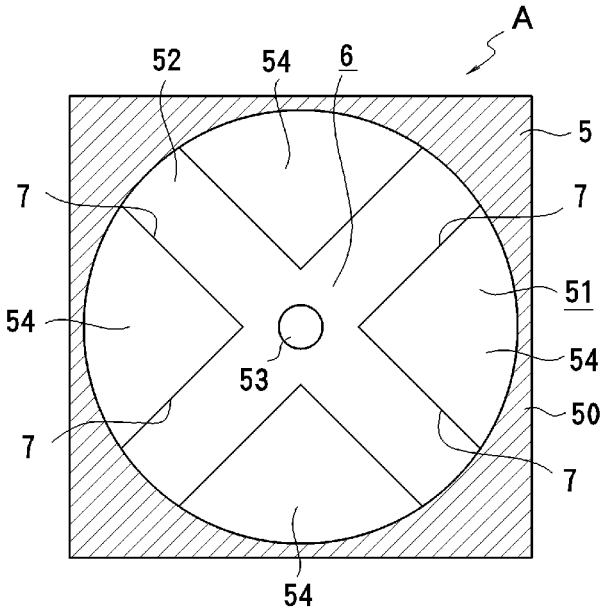
FIG. 2 is a sectional view of FIG. 1 taken along line II-II.
Figure 3:
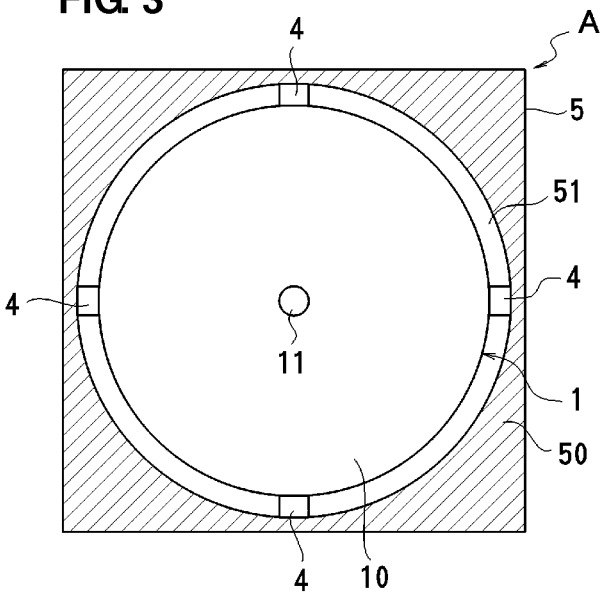
FIG. 3 is a sectional view of FIG. 1 taken along line III-III.

FIGS. 1 to 3 illustrate a piezoelectric micro-blower according to a first preferred embodiment of the present invention. The piezoelectric micro-blower is preferably used as an air blower for an electronic apparatus. The piezoelectric micro-blower A preferably includes an inner case 1 and an outer case 5 arranged to cover the outer periphery of the inner case 1 in a non-contact manner with a predetermined gap α provided therebetween. The inner case 1 and the outer case 5 are preferably connected to each other by a plurality of connecting portions 4. In the present preferred embodiment, as illustrated in FIG. 2, the outer case 5 preferably includes a side wall portion 50 and a top wall portion 52, and a cylindrical hollow section 51 that is open at the bottom is provided in the outer case 5. The inner case 1, which is preferably disc-shaped, for example, is disposed in the hollow section 51 such that the predetermined gap α is provided. The connecting portions 4 are provided between an outer peripheral portion of the inner case 1 and the side wall portion 50 of the outer case 5. The inner case preferably has an angular U-shape in cross section that is open at the bottom, for example. A diaphragm 21 of a vibrating plate 2 is fixed to the inner case 1 so as to close the open side thereof, so that a blower chamber 3 is provided between the inner case 1 and the vibrating plate 2. The vibrating plate 2 according to the present preferred embodiment preferably has a unimorph structure, for example, in which a piezoelectric element 20 made of a piezoelectric ceramic is bonded to a central portion of the diaphragm 21 made of a thin metal plate. Resonance vibration of the entire body of the vibrating plate 2 in a bending mode is generated when a voltage with a predetermined frequency is applied to the piezoelectric element 20.

A first opening 11 is preferably provided in a top plate portion (wall portion) 10 of the inner case 1 that faces a central portion of the vibrating plate 2. The top plate portion 10 of the inner case 1 is preferably thin, for example, so that the top plate portion 10 resonates in response to the resonance vibration of the vibrating plate 2. A second opening 53 that is aligned with the first opening 11 is preferably provided in the top plate portion (wall portion) 52 of the outer case 5 that faces the top plate portion 10 of the inner case 1. In the present preferred embodiment, the second opening 53 is preferably larger than the first opening 11. A projecting portion (peripheral wall portion) 54 is provided on an inner surface of the top plate portion 52 of the outer case 5, that is, a surface of the top plate portion 52 that faces the top plate portion 10 of the inner case 1. The projecting portion 54 projects toward the inner case 1, and is preferably located near the top plate portion 10 with a small gap β provided therebetween. The gap β may be smaller than the gap α, and is preferably set to a dimension such that the top plate portion 10 does not come into contact with the projecting portion 54 when the top plate portion 10 resonates. A height γ of the projecting portion 54 may preferably be greater than the gap β, and may preferably be equal or substantially equal to the gap α, for example. A central space 6 that communicates with the first opening 11 and the second opening 53 is provided inside the inner periphery of the projecting portion 54. Inflow passages 7 (see FIG. 2) defined by a plurality of grooves (preferably four grooves in this preferred embodiment, for example) that extend radially from the central space 6 are provided in the projecting portion 54. In this preferred embodiment, not only the inflow passages 7 but also the gap β between the projecting portion 54 and the top plate portion 10 functions as an inflow passage. Since the gap β extends over the entire or substantially the entire circumference, the flow passage resistance can be reduced and the flow rate can be increased.

As illustrated in FIG. 3, a plurality of connecting portions 4 (preferably four connecting portions 4 in this preferred embodiment, for example) are arranged along the circumferential direction at locations corresponding to phases different from those of the inflow passages 7. The connecting portions 4 retain the inner case 1 in the outer case 5. The connecting portions 4 are preferably defined by spring members, such as plate springs, for example, and have a low spring elasticity in a direction in which the vibrating plate vibrates in a bending mode and a high spring elasticity in a direction perpendicular or substantially perpendicular to the direction in which the vibrating plate vibrates in the bending mode. Therefore, when the inner case 1 vibrates in the vertical or substantially vertical direction in response to the resonance vibration of the vibrating plate 2, the connecting portions 4 prevent leakage of the vibration to the outer case 5.

An annular gap α is provided between the outer periphery of the inner case 1 and the inner periphery of the side wall portion 50 of the outer case 5. Outside air is sucked in through the gap α and is guided through the inflow passages 7 to the central space 6. Although the connecting portions 4 are provided in the gap α, the connecting portions 4 do not significantly increase the flow passage resistance against the air since the connecting portions 4 are arranged with intervals therebetween in the circumferential direction.

The operation of the piezoelectric micro-blower A having the above-described structure will now be described. When an alternating voltage with a predetermined frequency is applied to the piezoelectric element 20, resonance vibration of the vibrating plate 2 in the first resonance mode or the third resonance mode is generated. Accordingly, a distance between the first opening 11 and the vibrating plate 2 varies. When the distance between the first opening 11 and the vibrating plate 2 increases, the air in the central space 6 is sucked into the blower chamber 3 through the first opening 11. When the distance between the first opening 11 and the vibrating plate 2 decreases, the air in the blower chamber 3 is discharged to the central space 6 through the first opening 11. Since the vibrating plate 2 is driven at a high frequency, high-speed, high-energy airflow is discharged to the central space 6 through the first opening 11, passes through the central space 6, and is discharged through the second opening 53. At this time, the airflow is discharged through the second opening 53 together with the air present in the central space 6. Therefore, continuous flows of air that extend through the inflow passages 7 toward the central space 6 are generated, and the air is continuously discharged through the second opening 53 as a jet of air. The manner in which the air flows is shown by arrows in FIG. 1.

If the top plate portion 10 of the inner case 1 is thin so that the top plate portion 10 resonates in response to the resonance vibration of the vibrating plate 2, the distance between the first opening 11 and the vibrating plate 2 varies in synchronization with the vibration of the vibrating plate 2. Therefore, as compared to a case in which the top plate portion does not resonate, the flow rate of the air discharged through the second opening 53 is significantly increased. If the overall body of the top plate portion 10 is thin as illustrated in FIG. 1, the overall body of the top plate portion 10 resonates. Therefore, the flow rate is further increased. The top plate portion 10 may resonate in either the first resonance mode or the third resonance mode.

The inner case 1 vibrates in the vertical or substantially vertical direction in response to the resonance vibration of the vibrating plate 2. However, since the inner case 1 is only retained by the connecting portions 4 in the outer case 5, the vibration of the inner case 1 does not significantly leak to the outer case 5. Therefore, the energy loss is reduced. As a result, a micro-blower that provides a large flow rate even when input energy is relatively low is provided. In addition, the outer case 5 does not significantly vibrate. Therefore, when the outer case 5 is fixed to a housing, a substrate, or other suitable structure, the vibration of the vibrating plate 2 is not affected by the fixing structure of the outer case 5 and variations in characteristics, such as the flow rate, for example, are eliminated.

Second Preferred Embodiment

Figure 4:
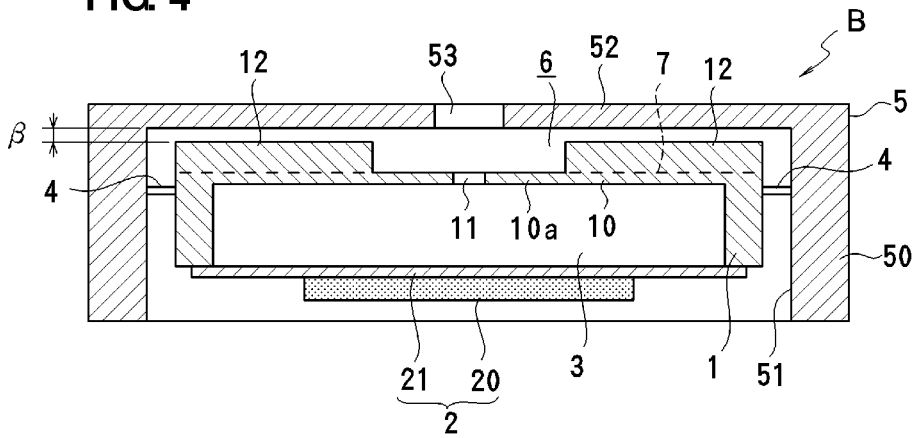
FIG. 4 is a schematic sectional view of a piezoelectric micro-blower according to a second preferred embodiment of the present invention.

FIG. 4 illustrates a piezoelectric micro-blower according to a second preferred embodiment of the present invention. In the piezoelectric micro-blower B according to the second preferred embodiment, components similar to those of the piezoelectric micro-blower A according to the first preferred embodiment are denoted by the same reference numerals and redundant descriptions thereof are omitted.

In the micro-blower B according to the second preferred embodiment, a projecting portion (peripheral wall portion) 12 that projects upward is preferably provided on a top surface of a top plate portion 10 of an inner case 1, and an inner surface of a top plate portion 52 of an outer case 5 is preferably flat or substantially flat, for example. Inflow passages 7 that extend radially are preferably provided in the projecting portion 12, for example. In this case, a portion of the top plate portion 10 of the inner case 1 other than a portion at which the projecting portion 12 is provided, that is, a portion 10*a* of the top plate portion 10 that faces the central space 6, resonates in the vertical or substantially vertical direction in response to the resonance vibration of the vibrating plate 2.

In the first and second preferred embodiments, it is not essential that the projecting portions 54 and 12 be provided, and the top surface of the top plate portion 10 of the inner case 1 and the bottom surface of the top plate portion 52 of the outer case 5 may both preferably be flat, for example. In this case, the entire space between the top plate portion 10 of the inner case 1 and the top plate portion 52 of the outer case 5 defines the central space 6 and the inflow passages 7.

Figure 5:
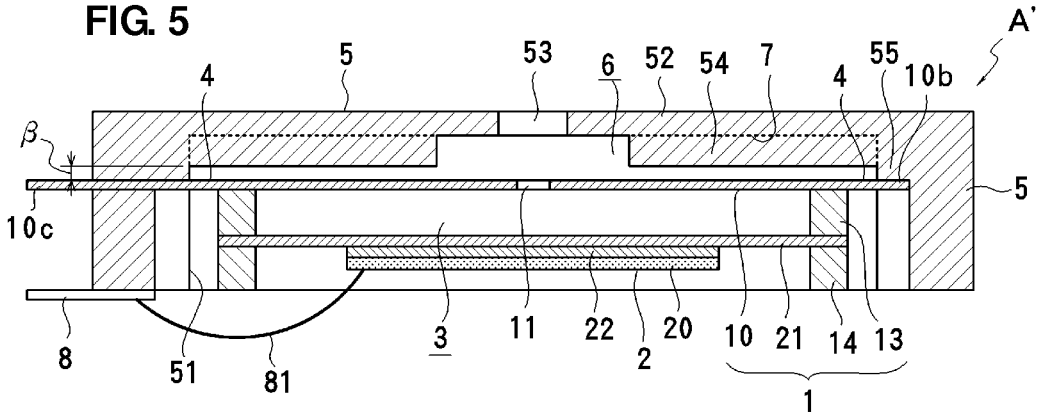
FIG. 5 is a sectional view of an example of a piezoelectric micro-blower according to the first preferred embodiment of the present invention.
Figure 6:
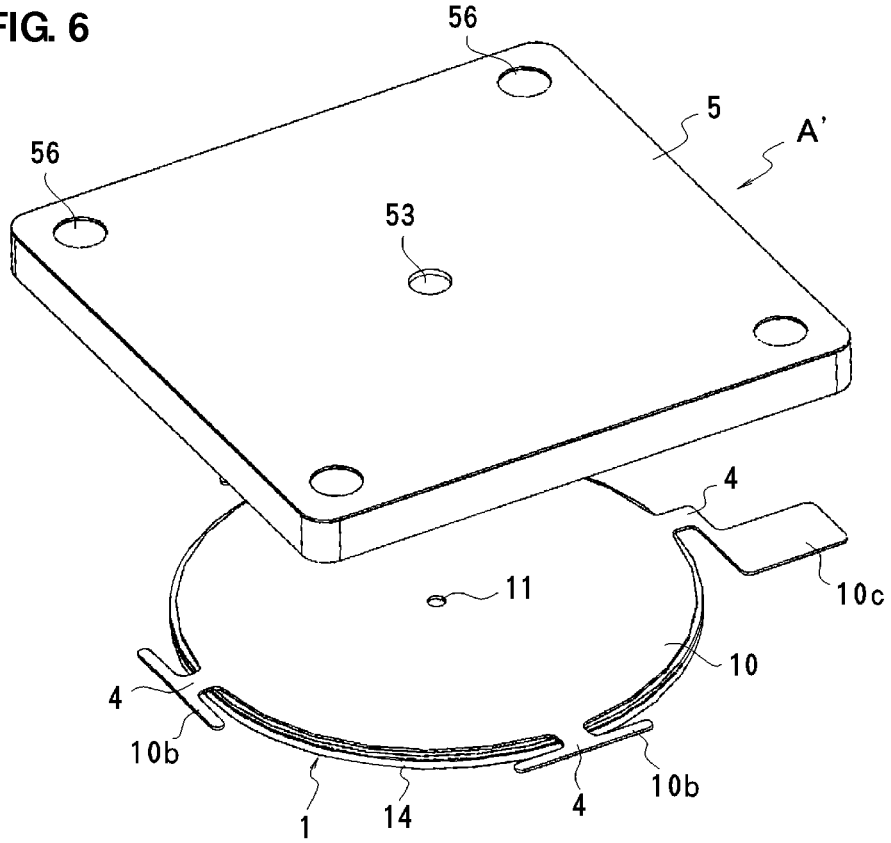
FIG. 6 is an exploded perspective view of the piezoelectric micro-blower illustrated in FIG. 5 seen from above.
Figure 7:
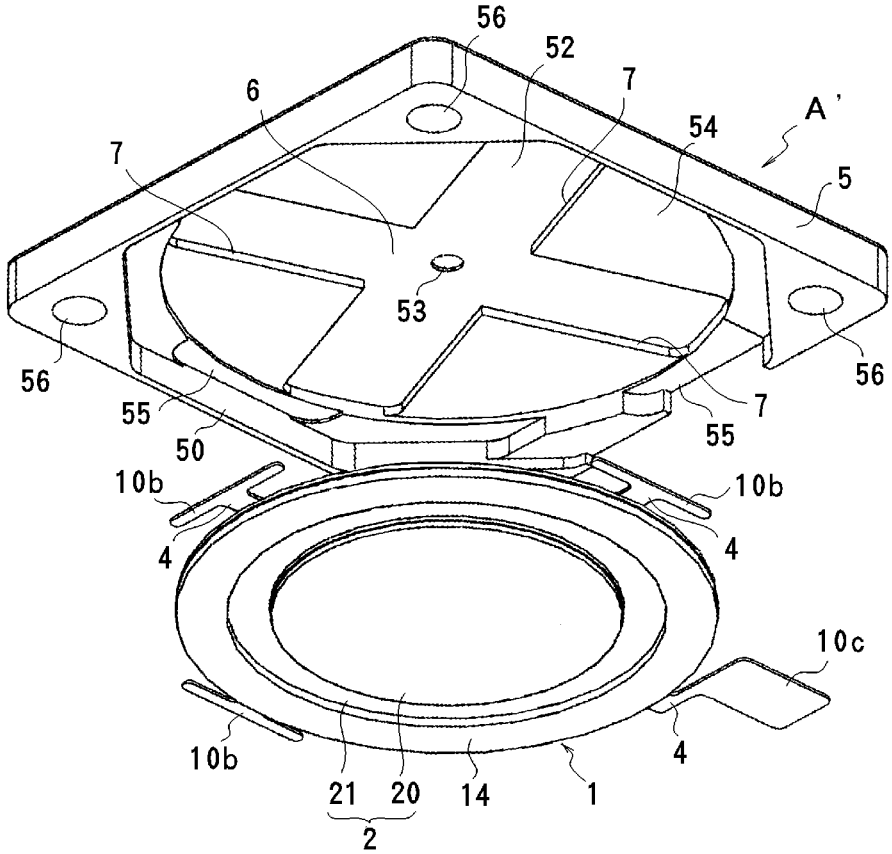
FIG. 7 is an exploded perspective view of the piezoelectric micro-blower illustrated in FIG. 5 seen from below.

FIGS. 5 to 7 illustrate an example of a micro-blower according to the first preferred embodiment of the present invention. Except for the components denoted by new reference numerals, components corresponding to those of the first preferred embodiment are denoted by the same reference numerals, and redundant descriptions thereof are omitted. An inner case 1 of this micro-blower A' preferably has a layered structure including a top plate 10, a first frame member 13 fixed to a bottom surface of the top plate 10 and having an annular shape, a vibrating plate 2 fixed to a bottom surface of the first frame member 13, and a second frame member 14 fixed to a bottom surface of the vibrating plate 2 and having an annular shape, for example. A thickness of a blower chamber 3 is determined by a thickness of the first frame member 13.

The top plate 10 is preferably made of a disc-shaped metal plate having spring elasticity, for example. As illustrated in FIG. 6, four narrow connecting portions 4 are preferably integrally provided with an outer peripheral portion of the top plate 10 with intervals of about 90° provided therebetween, for example. The connecting portions 4 are provided with wide attachment portions 10*b* and 10*c* at outer ends thereof. One attachment portion 10*c* projects outward from the outer case 5. The attachment portion 10*c* defines one of electrode terminals arranged to apply a voltage to a piezoelectric element 20. The first frame member 13 and the second frame member 14 are also preferably made of a metal material, for example, and retain a metal diaphragm 21 of the vibrating plate 2 between the first frame member 13 and the second frame member 14 at the upper side and the lower side of the diaphragm 21. Thus, an electrode at one side of the piezoelectric element 20 can be electrically connected to the electrode terminal 10*c* in the top plate 10 without providing additional wiring.

The vibrating plate 2 preferably includes the diaphragm 21 and the piezoelectric element 20 that are bonded together with an intermediate plate 22 disposed therebetween. The intermediate plate 22 is preferably made of a metal plate similar to the diaphragm 21, for example, and is set such that, when the vibrating plate 2 bends, a neutral plane of displacement of the vibrating plate 2 is within the thickness of the intermediate plate 22.

The outer case 5 is preferably arranged to have an integral shape using, for example, a resin material, and another electrode terminal 8 is fixed to an end surface of a peripheral wall portion of the outer case 5. An electrode provided at the other side of the piezoelectric element 20 is electrically connected to the electrode terminal 8 through a lead wire 81. Retaining surfaces 55 are provided on a side wall portion 50 of the outer case 5 preferably at four positions thereof along the circumferential direction, for example. The attachment portions 10*b* and 10*c* of the top plate 10 are fixed to the retaining surfaces 55, so that the inner case 1 is elastically retained in the outer case 5 in a floating state. A plurality of attachment holes 56 are preferably arranged so as to extend through the peripheral wall portion of the outer case 5 in the vertical or substantially vertical direction. The micro-blower A' is preferably attached to, for example, a housing or a substrate inserting bolts (or screws) through the attachment holes 56 and fastening the bolts (or screws) to the housing or the substrate. Alternatively, the micro-blower A' may be fixed using an adhesive instead of bolts, for example. In this example, the outer case 5 preferably includes a hollow section 51 that is open at the bottom, and the piezoelectric element 20 is exposed to the outside. However, the piezoelectric element 20 may be covered by closing the bottom opening of the outer case 5 with a cover.

Figure 8:
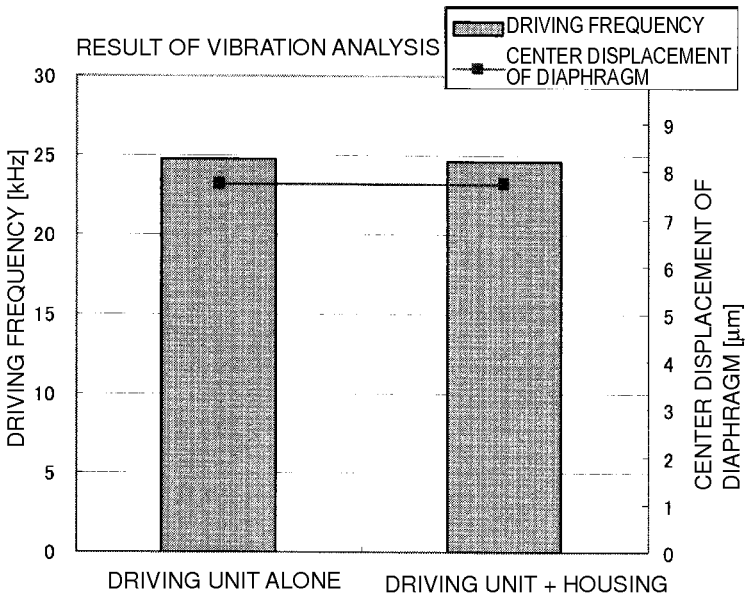
FIG. 8 is a graph in which the driving frequency and the center displacement of the diaphragm in a driving unit alone (inner case and vibrating plate) in the piezoelectric micro-blower illustrated in FIG. 5 are compared with those in a connected structure in which the driving unit is connected to the outer case with the connecting portions.

FIG. 8 illustrates the results of a simulation which was performed under the conditions given below. In the simulation, the driving frequency and the center displacement of the diaphragm in a driving unit alone (inner case and vibrating plate) in the micro-blower A' were compared with those in a connected structure in which the driving unit is connected to the outer case with the connecting portions. The simulation was based on the assumption that the space between the top plate 10 of the inner case 1 and the top plate 52 of the outer case 5 defines the central space 6 (the projecting portion 54 defining the flow passages is omitted).

Blower chamber (inner diameter, thickness)=(ϕ about 14 mm, t about 0.15 mm)

Piezoelectric element (diameter, thickness)=(ϕ about 11 mm, t about 0.15 mm)

Diaphragm (driving-area diameter, thickness, material)=(ϕ about 17 mm, t about 0.05 mm, 42Ni)

Top plate of inner case (driving-area diameter, thickness, material)=(ϕ about 17 mm, t about 0.1 mm, SUS430)

First opening (top plate of blower chamber)=(ϕ about 0.6 mm)

Connecting portions (length, width, thickness, material)=(about 0.5 mm, about 1 mm, about 0.1 mm, SUS430)

Top plate of outer case (diameter, thickness, material)=(ϕ about 18 mm, about 0.3 mm, PBT)

Gap between outer periphery of inner case and side wall portion of outer case=α (about 0.5 mm)

Central space (diameter, thickness)=(ϕ about 18 mm, about 0.5 mm)

According to this simulation, the flow rate was about 0.8 L/min when the vibrating plate was driven at about 26 kHz and about 15 Vpp. In this case, as illustrated in FIG. 9A, the driving area of the vibrating plate (ϕ about 17 mm) was vibrated in the third mode and the driving area of the top plate of the inner case (ϕ about 17 mm) was vibrated in the third mode in a manner different from that of the vibrating plate.

As is clear from FIG. 8, when the driving unit and the connected structure are compared with each other, differences in the driving frequency and the center displacement are very small. Therefore, it is clear that the vibration does not significantly leak to the outer case through the connecting portions. In particular, where the vibrating plate and the top plate of the inner case are vibrated in the mode shown in FIG. 9A and the diameter of the piezoelectric element is less than the inner diameter of the blower chamber, displacements of outer peripheral portions of the vibrating plate and the top plate of the inner case are both small. Therefore, it is clear that the vibration does not significantly leak to the outer case because the portions at which the displacements are small are retained by the connecting portions having spring elasticity.

Figure 9:
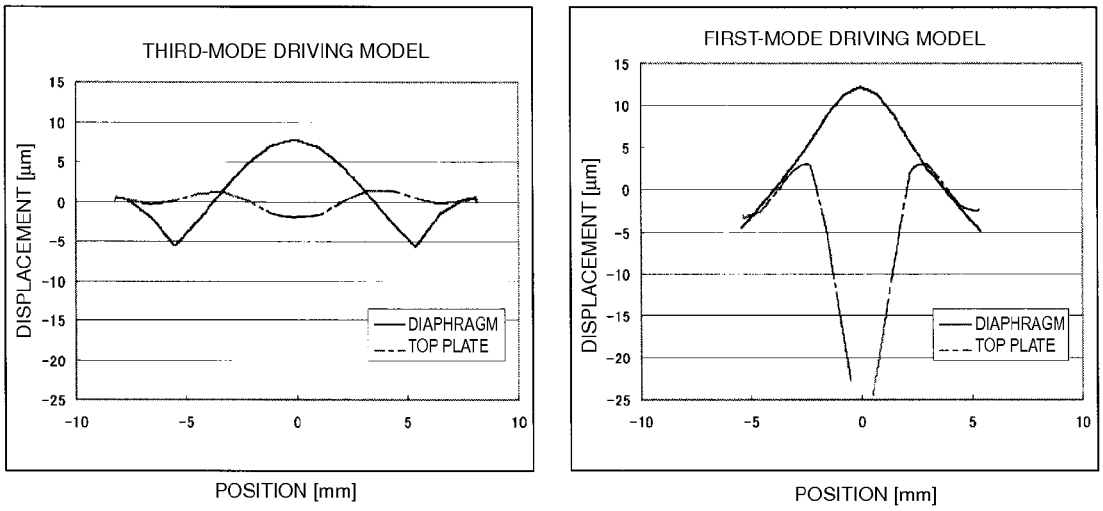
FIG. 9 shows graphs illustrating vibration modes of a vibrating plate and a top plate of an inner case where the vibrating plate is driven in a third mode and a first mode.

FIG. 9A illustrates the case in which the vibrating plate is driven in the third mode, and FIG. 9B illustrates the case in which the vibrating plate is driven in the first mode. The diameter of the piezoelectric element is substantially the same as that of the diaphragm, and is greater than the inner diameter of the blower chamber. In this case, the top plate of the inner case vibrates in the third mode such that nodes are provided at a central area of the top plate and an area surrounding the central area. The vibrating plate and the top plate of the inner case vibrate such that outer peripheral edges thereof function as free ends. Therefore, the connecting portions that retain the outer peripheral edge of the top plate of the inner case preferably have high spring elasticity. The displacement of the central portion of the top plate of the inner case is greater than the displacement of the central portion of the vibrating plate. Therefore, the flow rate can be increased as compared to the case in which the vibrating plate is driven in the third mode (FIG. 9A).

As described above, in the micro-blower according to the present example of the first preferred embodiment of the present invention, the inner case and the outer case are connected to each other preferably by the connecting portions having spring elasticity. Therefore, the energy loss caused when the vibration energy of the driving unit leaks to the outer case is greatly reduced. Accordingly, a desired flow rate is provided even when the size of the micro-blower is reduced. In addition, the flow rate characteristics can be maintained irrespective of a method by which the micro-blower is mounted. In addition, since the gap β (about 0.1 mm) between the inner case and the projecting portion functions as a flow passage, compared to the case in which an inflow passage having a constant thickness is provided, the flow passage resistance can be reduced and the flow rate can be increased.

Figure 10:
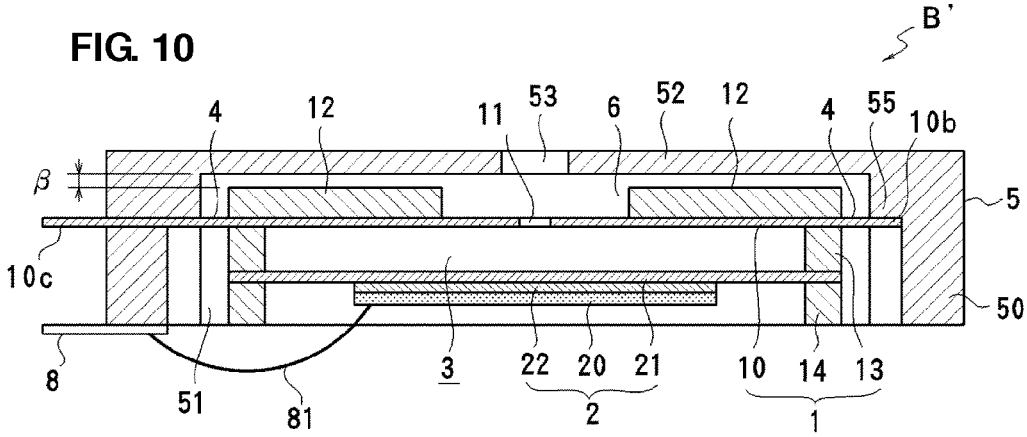
FIG. 10 is a sectional view of an example of a piezoelectric micro-blower according to the second preferred embodiment of the present invention.
Figure 11:
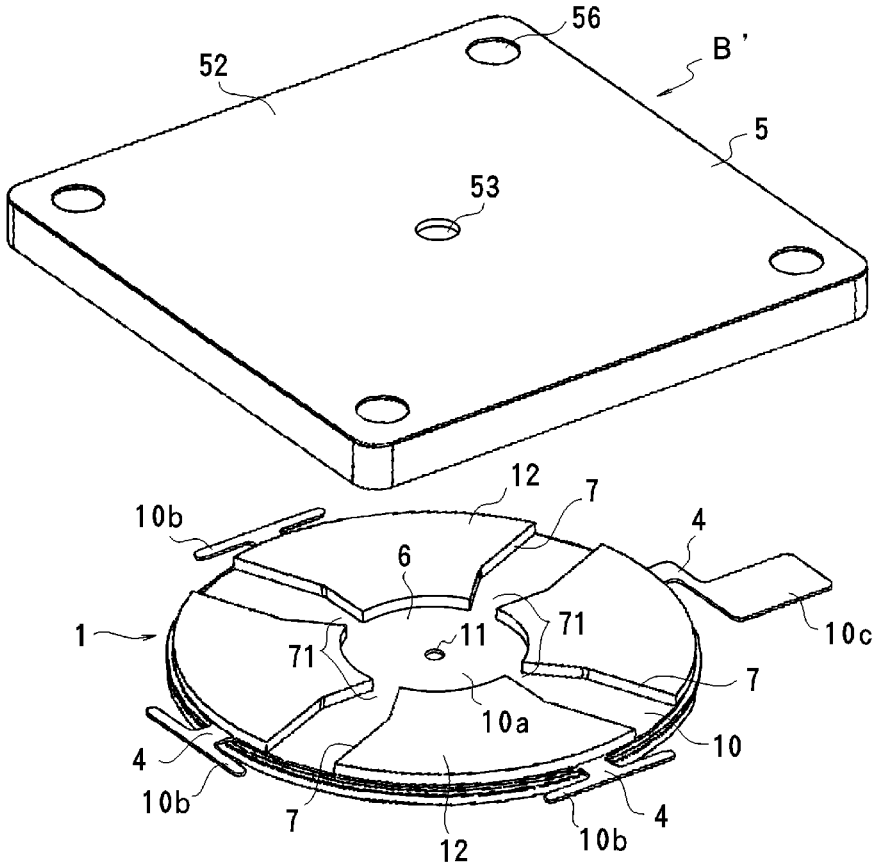
FIG. 11 is an exploded perspective view of the piezoelectric micro-blower illustrated in FIG. 10 seen from above.
Figure 12:
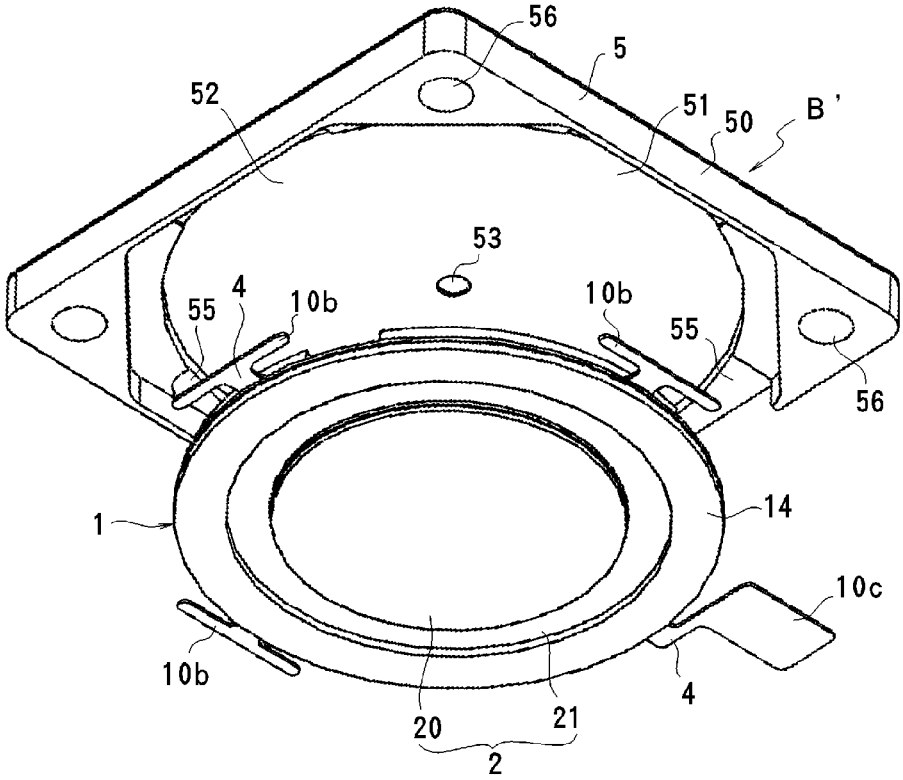
FIG. 12 is an exploded perspective view of the piezoelectric micro-blower illustrated in FIG. 10 seen from below.

FIGS. 10 to 12 illustrate an example of a micro-blower B according to the second preferred embodiment of the present invention. Components corresponding to those of the micro-blower A' according to the first example are denoted by the same reference numerals and redundant descriptions thereof are thus omitted. In this micro-blower B', a plurality of projecting portions (peripheral wall portions) 12 are preferably bonded to a top surface of a top plate 10 of an inner case 1. A gap β is provided between the top surface of each projecting portion 12 and a top plate 52 of an outer case 5. Groove-shaped inflow passages 7, for example, are preferably provided between the projecting portions 12 so as to extend radially, and narrowed portions 71 are preferably provided at the inner ends of the inflow passages 7. The inflow passages 7 communicate with a central space 6 through the narrowed portions 71. The central space 6 is preferably arranged concentrically with the first opening 11, for example. Only a portion of the top plate 10 other than a portion at which the projecting portions 12 are bonded, that is, a portion 10*a* that faces the central space 6, resonates when the vibrating plate 2 is driven.

Third Preferred Embodiment

Figure 13:
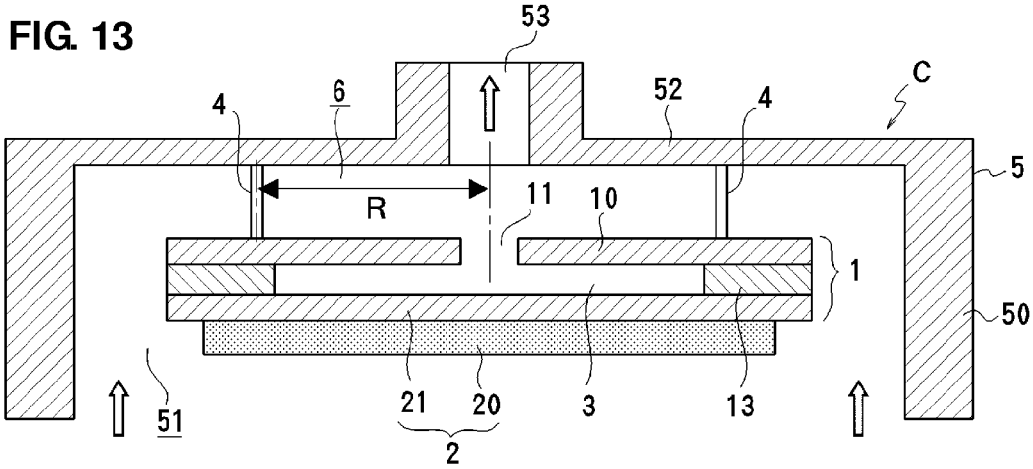
FIG. 13 is a schematic sectional view of a piezoelectric micro-blower according to a third preferred embodiment of the present invention.
Figure 14:
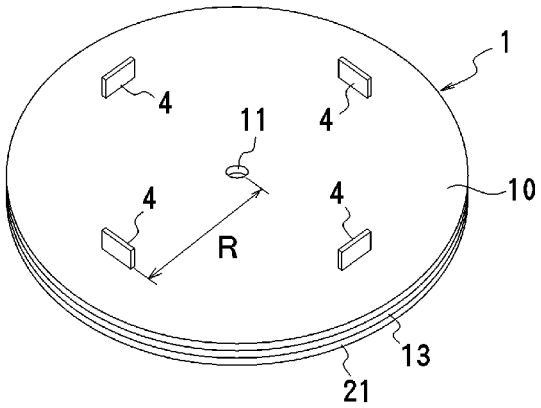
FIG. 14 is a perspective view of a driving unit included in the piezoelectric micro-blower according to the third preferred embodiment of the present invention.

FIGS. 13 and 14 illustrate a piezoelectric micro-blower according to a third preferred embodiment of the present invention. In the piezoelectric micro-blower C according to the third preferred embodiment, components similar to those of the piezoelectric micro-blowers A and B according to the first and second preferred embodiments are denoted by the same reference numerals, and redundant descriptions thereof are thus omitted.

In the micro-blower C according to the third preferred embodiment, a plurality of connecting portions 4 (preferably four connecting portions 4 in this preferred embodiment, for example) are provided on a top surface of a top plate 10 of an inner case 1 so as to extend vertically or substantially vertically. The top plate 10 is preferably fixed to a top plate of an outer case 5 using the connecting portions 4, for example. The connecting portions 4 may be defined by members that do not have spring elasticity, but are preferably defined by spring members. A distance R from the center of the top plate 10 (first opening 11) to the connecting portions 4 in the radial direction is preferably set such that the connecting portions 4 are located at a node of vibration of the top plate 10. Other structures are substantially similar to those of the first preferred embodiment, except the projecting portion 12 or 54 arranged to define the flow passages are not provided. Therefore, the space between the top plate 10 of the inner case 1 and the top plate 52 of the outer case 5 defines a central space 6.

Figure 15:
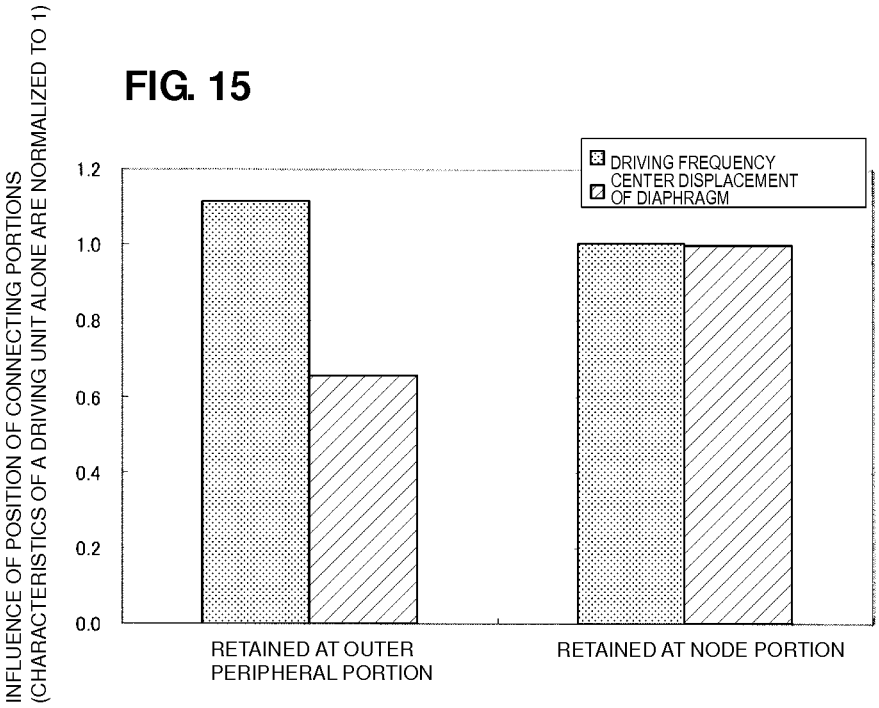
FIG. 15 is a graph in which the driving frequency and the center displacement of the diaphragm in the piezoelectric micro-blower according to the third preferred embodiment of the present invention are compared with those of a comparative example.

FIG. 15 illustrates the result of an analysis of the driving frequency and the center displacement of the diaphragm in a driving process using the piezoelectric micro-blower C in which the connecting portions 4 are connected at the node of vibration so as to extend vertically or substantially vertically and a comparative example in which the connecting portions 4 are connected to an outer peripheral edge portion of the top plate 10. The graph in FIG. 15 shows the ratio of the characteristics of the structure of the driving unit alone (inner case 1 and vibrating plate 2) relative to the connected structure in which the driving unit is connected to the outer case 5 with the connecting portions. The driving frequency was about 25 kHz, which is a frequency at which the vibrating plate that vibrates in the first resonance mode and the inner case resonate when the vibrating plate is driven at about 15 Vpp. Dimensions of components of the driving unit are shown below. The space between the top plate 10 of the inner case 1 and the top plate 52 of the outer case 5 defines the central space 6.

Blower chamber (inner diameter, thickness)=(ϕ about 5 mm, t about 0.15 mm)

Piezoelectric element (diameter, thickness)=(ϕ about 11 mm, t about 0.1 mm)

Diaphragm (driving-area diameter, thickness, material)=(ϕ about 11 mm, t about 0.1 mm, 42Ni)

Top plate of blower chamber (driving-area diameter, thickness, material)=(ϕ about 11 mm, t about 0.05 mm, SUS430)

First opening (top plate of blower chamber)=(ϕ0.6 mm)

Connecting portions (length, width, thickness, material)=(about 0.5 mm, about 1 mm, about 0.05 mm, SUS430)

Distance R=about 4 mm

Top plate of outer case (diameter, thickness, material)=(ϕ about 12 mm, t about 0.3 mm, PBT)

Gap between outer periphery of inner case and side wall portion of outer case=α (about 0.5 mm)

Central space (diameter, thickness)=(ϕ about 12 mm, t about 0.4 mm)

In FIG. 15, the left side shows an example in which the top plate of the inner space is retained at the outer peripheral portion, and the right side shows the case in which the top plate of the inner space is retained at a node portion. In this analysis, the vibrating plate is driven in the first mode. Therefore, similar to the case illustrated in FIG. 9B, the vibrating plate and the top plate of the inner case vibrate such that the outer peripheral edges thereof function as free ends, and nodes of vibration are somewhat inwardly spaced from the outer peripheral edges. In addition, the node of vibration of the top plate of the inner case is at substantially the same location as the node of vibration of the vibrating plate. As is clear from FIG. 15, where the top plate of the inner space is retained at the outer peripheral portion (comparative example), the outer peripheral portion, which is the free end, is restrained by the retaining members. Therefore, the driving frequency is increased by about 10% as compared to that of the driving unit alone. In addition, the vibration is transmitted from the outer peripheral portion, which is the free end, to the outer case through the retaining members. Therefore, the center displacement of the diaphragm, which affects the flow rate characteristics, is reduced to about 66%. In contrast, where the top plate of the inner space is retained at the location of the node portion (R=about 4 mm) as in the piezoelectric micro-blower C, the driving frequency is equal or substantially equal to the driving frequency of the driving unit alone and the difference in the center displacement of the diaphragm is less than about 1%. Therefore, it is clear that when the connecting portions are connected to the node portion of the top plate of the inner case, the energy loss caused by leakage of the vibration in the inner case to the outer case is extremely low.

The first resonance mode referred to herein is the vibration mode of the vibrating plate, and is not the vibration mode of the top plate (wall portion) of the inner case. The top plate of the inner case vibrates in response to the vibration of the vibrating plate on which the piezoelectric element is provided. However, the top plate of the inner case vibrates in a complex manner, and the vibration mode thereof does not always match the vibration mode of the vibrating plate. In this analysis, the vibrating plate including the piezoelectric element vibrates in the first resonance mode such that the outer periphery thereof functions as a free end, and the vibration of the top plate of the inner case has a node at a location inwardly spaced from the outer peripheral edge of the inner case. The location of the node can be determined by individually measuring the vibration of the top plate of the inner case with an LDV (Laser Doppler Velocimeter). Therefore, depending on the state of vibration of the vibrating plate, there is a possibility that the node of vibration of the inner case will be at the outer peripheral edge of the top plate of the inner case.

The reason why the center displacement of the diaphragm is large as illustrated in FIG. 15 is not only because the top plate of the inner case is retained at the node portion thereof but also because the diameter of the piezoelectric element 20 is greater than the diameter of the blower chamber 3. More specifically, when the diameter of the piezoelectric element 20 is greater than the diameter of the blower chamber 3, the outer peripheral edge of the piezoelectric element 20 is located at the first frame member 13. Therefore, it may be considered that the movement of the piezoelectric element 20 is restrained by the first frame member 13 and the displacement is reduced. However, when the diameter of the piezoelectric element 20 is greater than the diameter of the blower chamber 3, if the thickness of the first frame member 13 is set such that the first frame member 13 can easily bend and the piezoelectric element 20 is driven in the first mode, then the overall body of the inner case 1 including the vibrating plate 2 can easily move such that the outer peripheral edge thereof functions as a free end. This is presumably the reason why the displacement of the vibrating plate 2 is large and, as a result, the displacement of the top plate of the inner case 1 is large. It can be expected that the flow rate can be further increased by setting the diameter of the blower chamber 3 such that the blower chamber 3 functions as a resonance space.

Figure 16:
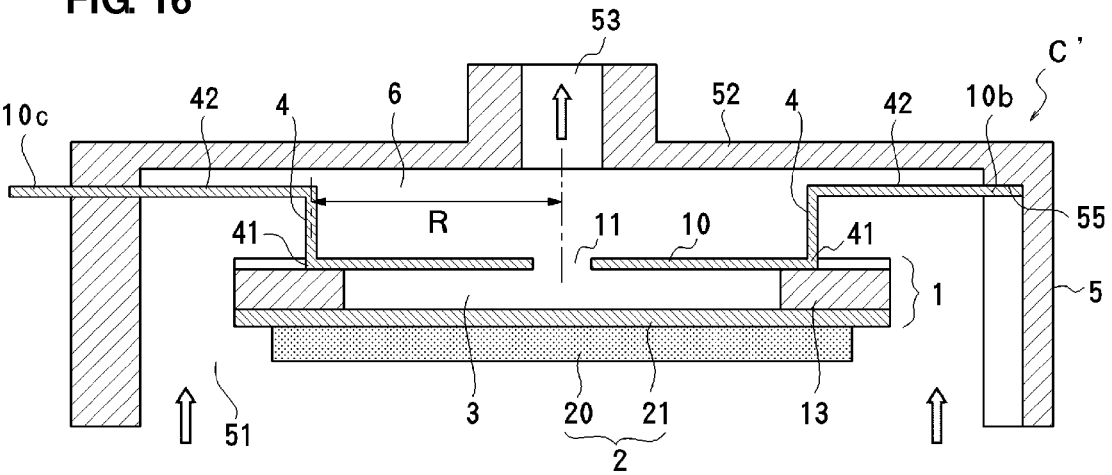
FIG. 16 is a sectional view of an example of a piezoelectric micro-blower according to the third preferred embodiment of the present invention.
Figure 17:
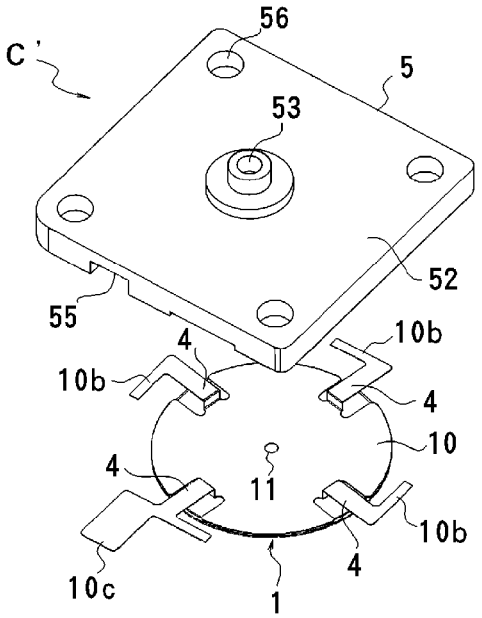
FIG. 17 is an exploded perspective view of the piezoelectric micro-blower illustrated in FIG. 16 seen from above.
Figure 18:
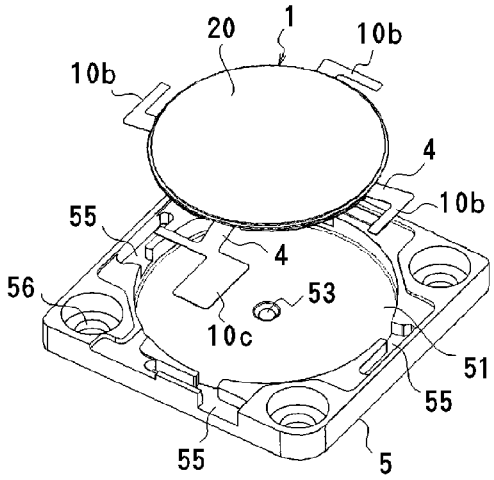
FIG. 18 is an exploded perspective view of the piezoelectric micro-blower illustrated in FIG. 16 seen from below.
Figure 19:
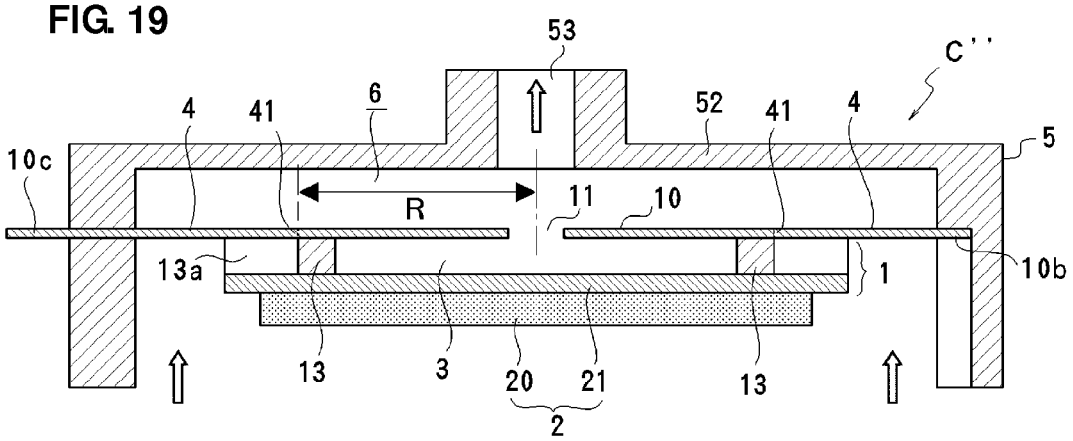
FIG. 19 is a sectional view of another example of a piezoelectric micro-blower according to the third preferred embodiment of the present invention.
Figure 20:
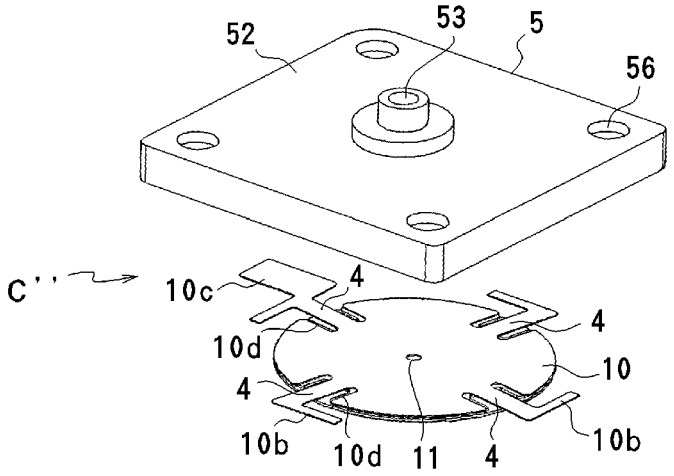
FIG. 20 is an exploded perspective view of the piezoelectric micro-blower illustrated in FIG. 19 seen from above.
Figure 21:
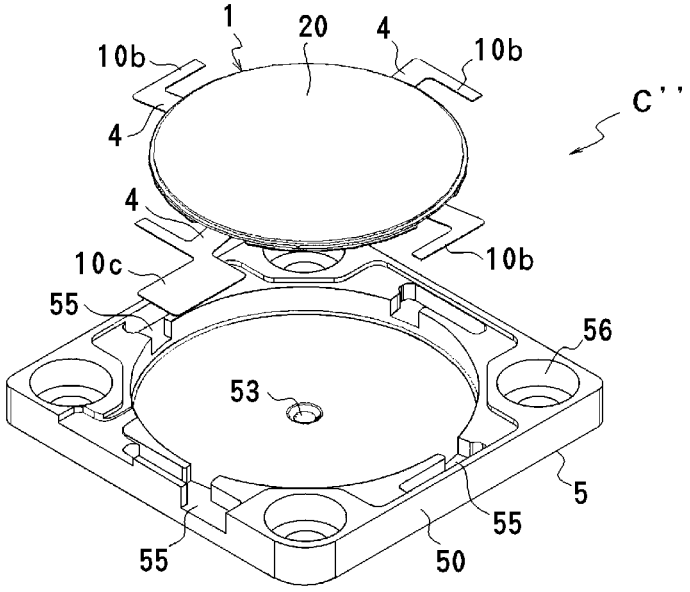
FIG. 21 is an exploded perspective view of the piezoelectric micro-blower illustrated in FIG. 19 seen from below.
Figure 22:
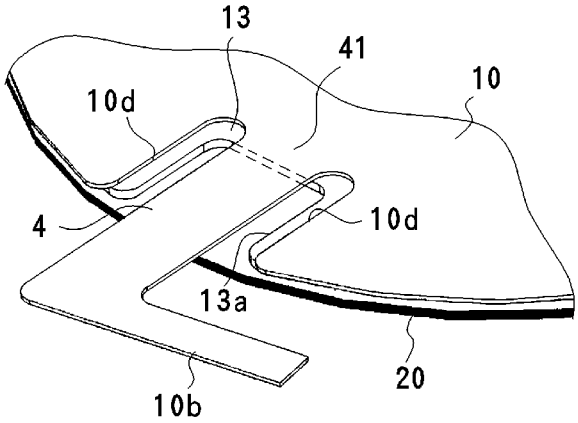
FIG. 22 is an enlarged view of a part of the structure illustrated in FIG. 20.

FIGS. 16 to 18 illustrate an example of a micro-blower C according to the third preferred embodiment of the present invention. Components corresponding to those illustrated in FIG. 13 are denoted by the same reference numerals and redundant descriptions thereof are thus omitted. An inner case 1 of this micro-blower C' preferably has a layered structure including a top plate 10, an annular frame member 13 fixed to a bottom surface of the top plate 10, and a diaphragm 21 fixed to a bottom surface of the frame member 13, for example. A blower chamber 3 is preferably provided inside the frame member 13.

The top plate 10 is preferably made of a disc-shaped metal plate having spring elasticity, for example. As illustrated in FIG. 17, four crank-shaped connecting portions 4 are preferably integrally arranged with the top plate 10 at an outer peripheral portion thereof, for example. The connecting portions 4 are preferably bent at a right angle with respect to the top plate 10, for example. A distance R between a first opening 11 and the connecting portions 4 is preferably set such that connecting positions at which inner end portions 41 of the connecting portions 4 are connected to the top plate 10 are at a node of vibration of the top plate 10, for example. Outer end portions 42 of the connecting portions 4 preferably radially project outward from the top plate 10, and are retained by an inner surface of a top plate 52 of an outer case 5. Attachment portions 10*b* provided at the ends of the outer end portions 42 are retained by retaining surfaces 55 of the outer case 5. One attachment portion 10*c* projects outward from the corresponding retaining surface 55 of the outer case 5 and defines an electrode terminal.

In this case, the connecting portions 4 can be integral with the top plate 10, so that the structure thereof can be simplified. In addition, since the outer end portions 42 of the connecting portions 4 are retained by the inner surface of the top plate 52 of the outer case 5, the inner case 1 can be stably retained in the outer case 5. In addition, the connecting portions 4 are preferably connected to the top plate 10 at the node of vibration of the top plate 10. Therefore, the connecting portions 4 do not substantially vibrate even when the top plate vibrates. In other words, it is not necessary that the connecting portions 4 have elasticity. Therefore, the material of the connecting portions 4 can be arbitrarily selected.

FIGS. 19 to 22 illustrate another example of a micro-blower C according to the third preferred embodiment of the present invention. Components corresponding to those in the example illustrated in FIGS. 16 to 18 are denoted by the same reference numerals and redundant descriptions thereof are thus omitted. In this micro-blower C", connecting portions 4 preferably radially extend in the same plane as the plane of a top plate 10. Slits 10*d* are preferably provided at either side of each connecting portion 4, and a distance by which the slits 10*d* are cut, in other words, a distance R between the center of the top plate 10 (first opening 11) and inner ends 41 of the connecting portions 4, is preferably set such that the inner ends 41 of the connecting portions 4 are at a node of vibration of the top plate 10. A frame member 13 is preferably interposed between the top plate 10 and a diaphragm 21. Cut portions 13*a* are provided in the frame member 13 at locations corresponding to the connecting portions 4 so that the connecting portions 4 do not contact the frame member 13 in an area outside the node of vibration. The cut portions 13*a* may be replaced by recessed portions.

In this example, it is not necessary to perform a bending process to form the connecting portions 4. Therefore, the top plate 10 can be easily formed.

The present invention is not limited to the above-described preferred embodiments and examples of the preferred embodiments. For example, in the preferred embodiments described above, the top plate portion of the inner case that faces the central space preferably is arranged to vibrate in response to the vibration of the vibrating plate. However, it is not always necessary to cause the top plate portion of the inner case to vibrate. The shape of the inflow passages is not limited to the linear shape that radially extends from the central space, and can be arbitrarily selected. In addition, the number of inflow passages can also be arbitrarily selected in accordance with the flow rate or the noise level. In addition, although a vibrating plate in which a disc-shaped piezoelectric element is bonded to a central portion of a diaphragm and a vibrating plate in which a disc-shaped piezoelectric element is bonded to a diaphragm with a disc-shaped intermediate plate interposed therebetween are described above, the shape of the piezoelectric element is not limited to a disc shape, and may instead be a ring shape, for example. A member of the inner case to which the connecting portions are connected at one end thereof may be any member, and is not limited to the top plate 10. For example, the member of the inner case to which the connecting portions are connected may be the first frame member 13, which is interposed between the top plate 10 and the diaphragm 21, or the diaphragm 21.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A piezoelectric micro-blower, comprising:

a vibrating plate including a piezoelectric element;

a case to which a peripheral portion of the vibrating plate is fixed, the case including an inner case and an outer case, a blower chamber being defined between the inner case and the vibrating plate;

a first opening provided in a wall portion of the case, the wall portion of the case being arranged to face a central portion of the vibrating plate; and a plurality of connecting portions each extending from a periphery of a top plate portion of the inner case to the outer case and connecting the inner case to the outer case, the plurality of connecting portions being arranged to prevent transmission of vibration from the case to outside of the case; wherein the vibrating plate is driven in a bending mode by applying a voltage with a predetermined frequency to the piezoelectric element, such that compressible fluid is discharged from the first opening; and a sum of a length of each of the plurality of connecting portions is less than a sum of a length of each of a plurality of non-connecting portions provided between the plurality of connecting portions on the periphery of the top plate as viewed from above the case.

2. The piezoelectric micro-blower according to claim 1, wherein the wall portion of the case, which is opposed to the vibrating plate, is arranged to vibrate when the vibrating plate is driven.

3. The piezoelectric micro-blower according to claim 1, wherein the plurality of connecting portions includes four connecting portions.

* * * * *